US011088468B2

(12) United States Patent
Joung et al.

(10) Patent No.: US 11,088,468 B2
(45) Date of Patent: Aug. 10, 2021

(54) ANTENNA MODULE

(71) Applicant: Samsung Electro-Mechanics Co., Ltd., Suwon-si (KR)

(72) Inventors: Il Kweon Joung, Suwon-si (KR); Yong Hyen Park, Suwon-si (KR); Jung Won Lee, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 358 days.

(21) Appl. No.: 16/166,494

(22) Filed: Oct. 22, 2018

(65) Prior Publication Data

US 2019/0207323 A1 Jul. 4, 2019

(30) Foreign Application Priority Data

Dec. 28, 2017 (KR) ..... 10-2017-0183034
Dec. 28, 2017 (KR) ..... 10-2017-0183035
Apr. 27, 2018 (KR) ..... 10-2018-0049390

(51) Int. Cl.
*H01Q 21/06* (2006.01)
*H01Q 1/22* (2006.01)
(Continued)

(52) U.S. Cl.
CPC ..... *H01Q 21/065* (2013.01); *H01Q 1/2283* (2013.01); *H01Q 1/243* (2013.01);
(Continued)

(58) Field of Classification Search
CPC ..... H01Q 1/2283
See application file for complete search history.

(56) References Cited

U.S. PATENT DOCUMENTS 11,011,844 B2 * 5/2021 Im ..... H01L 23/3128
2004/0113840 A1 * 6/2004 Gottwald ..... H01Q 9/045 343/700 MS
(Continued)

FOREIGN PATENT DOCUMENTS

CN 104025377 A 9/2014
CN 105794043 A 7/2016
(Continued)

OTHER PUBLICATIONS

Korean Office Action dated Feb. 20, 2019 in corresponding Korean patent application No. 10-2018-0049390 (5 pages in English and 4 pages in Korean).
(Continued)

*Primary Examiner* — Ab Salam Alkassim, Jr.
(74) *Attorney, Agent, or Firm* — NSIP Law

(57) ABSTRACT

An antenna module including two or more substrates stacked and having different flexibility, a patch antenna disposed above or within an uppermost substrate from among the two or more substrates, and an IC disposed below or within a lowermost substrate from among the two or more substrates, and electrically connected to the patch antenna through the substrates, wherein the two or more substrates comprise a first substrate and a second substrate, and wherein the second substrate is more flexible than the first substrate, and extends in a lateral direction to have an overlap region overlapping the first substrate and an extension region not overlapping the first substrate.

20 Claims, 18 Drawing Sheets

(51) Int. Cl.

| | |
|---|---|
| ***H01Q 1/52*** | (2006.01) |
| ***H01Q 9/04*** | (2006.01) |
| ***H01Q 25/00*** | (2006.01) |
| ***H01Q 1/24*** | (2006.01) |
| ***H01Q 21/28*** | (2006.01) |

(52) U.S. Cl.

CPC ..... *H01Q 1/523* (2013.01); *H01Q 1/526* (2013.01); *H01Q 9/0407* (2013.01); *H01Q 9/0414* (2013.01); *H01Q 21/28* (2013.01); *H01Q 25/00* (2013.01); *H01Q 25/005* (2013.01)

(56) References Cited

U.S. PATENT DOCUMENTS

| | | | | |
|---|---|---|---|---|
| 2014/0145883 | A1* | 5/2014 | Baks | H01Q 1/2283 343/700 MS |
| 2016/0276751 | A1 | 9/2016 | Ueda | |
| 2017/0040673 | A1 | 2/2017 | Kanno et al. | |
| 2018/0026341 | A1* | 1/2018 | Mow | H04B 10/90 343/702 |
| 2018/0062263 | A1* | 3/2018 | Ueda | H01Q 21/29 |
| 2018/0159203 | A1* | 6/2018 | Baks | H01Q 1/2283 |
| 2019/0089052 | A1* | 3/2019 | Yong | H01Q 1/2283 |
| 2019/0288371 | A1* | 9/2019 | Kamgaing | H01Q 9/0457 |
| 2019/0372229 | A1* | 12/2019 | Dalmia | H01Q 9/0407 |
| 2020/0194893 | A1* | 6/2020 | Im | H01L 23/5387 |
| 2020/0274221 | A1* | 8/2020 | Suzuki | H01Q 23/00 |
| 2020/0312798 | A1* | 10/2020 | Kawahata | H01Q 9/42 |
| 2020/0373646 | A1* | 11/2020 | Murata | H01Q 1/2283 |
| 2020/0373655 | A1* | 11/2020 | Takayama | H01Q 1/2283 |
| 2020/0381843 | A1* | 12/2020 | Murata | H01Q 11/14 |
| 2020/0403321 | A1* | 12/2020 | Kang | H01Q 21/0025 |

FOREIGN PATENT DOCUMENTS

| | | | |
|---|---|---|---|
| CN | 106450661 | A | 2/2017 |
| JP | 2003-87022 | A | 3/2003 |
| JP | 2003-332830 | A | 11/2003 |
| JP | 2015-26915 | A | 2/2015 |
| KR | 10-2006-0019443 | A | 3/2006 |
| KR | 10-2013-0028790 | A | 3/2013 |
| KR | 10-2016-0130290 | A | 11/2016 |
| WO | WO 2013/102225 | A1 | 7/2013 |
| WO | WO 2015/171118 | A1 | 11/2015 |

OTHER PUBLICATIONS

Chinese Office Action dated May 8, 2020 in counterpart Chinese Patent Application No. 201811609607.4 (13 pages in English and 9 pages in Chinese).

Chinese Office Action dated Dec. 3, 2020 in counterpart Chinese Patent Application No. 201811609607.4 (13 pages in English and 8 pages in Chinese).

* cited by examiner

ANTENNA MODULE

CROSS-REFERENCE TO RELATED APPLICATIONS

This application claims the benefit under 35 U.S.C. § 119(a) of Korean Patent Application Nos. 10-2017-0183034 filed on Dec. 28, 2017, 10-2017-0183035 filed on Dec. 28, 2017 and 10-2018-0049390 filed on Apr. 27, 2018 in the Korean Intellectual Property Office, the entire disclosures of which are incorporated herein by reference for all purposes.

BACKGROUND

1. Field

The following description relates to an antenna module.

2. Description of Related Art

Data traffic of mobile communications is rapidly increasing, and technological development is underway to support the transmission of the increased data in real time in wireless networks. For example, the contents of internet of things (IoT) based data, augmented reality (AR), virtual reality (VR), live VR/AR combined with SNS, autonomous navigation, applications such as Sync View (real-time video transmissions of users using ultra-small cameras) may require communications (e.g., 5G communications, mmWave communications, etc.) supporting the transmission and reception of large amounts of data.

Recently, research is being conducted in millimeter wave (mmWave) communications, including $5^{th}$ generation (5G) communications and the commercialization/standardization of an antenna module smoothly realizing such communications.

Since RF signals in high frequency bands (e.g., 24 GHz, 28 GHz, 36 GHz, 39 GHz, 60 GHz, etc.) are easily absorbed and lost in the course of the transmission thereof, the quality of communications may be dramatically reduced. Therefore, antennas for communications in high frequency bands may require different approaches from those of conventional antenna technology, and a separate approach may require further special technologies, such as separate power amplifiers for securing antenna gain, integrating an antenna and RFIC, and securing effective isotropic radiated power (EIRP), and the like.

Traditionally, antenna modules providing a millimeter wave communications environment have been used to dispose ICs and antennas on a substrate to meet the requirements of high frequency antenna performance (e.g., transmission/reception ratio, gain, directivity, etc.). However, such a structure may lead to a lack of a space for arranging the antenna, a limitation in the degree of freedom of the antenna shape, an increase in interference between the antenna and the IC, and an increase in the size and/or cost of the antenna module.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

According to an aspect there is disclosed an antenna module including two or more substrates stacked and having different flexibility, a patch antenna disposed above or within an uppermost substrate from among the two or more substrates, and an IC disposed below or within a lowermost substrate from among the two or more substrates, and electrically connected to the patch antenna through the substrates, wherein the two or more substrates comprise a first substrate and a second substrate, and wherein the second substrate is more flexible than the first substrate, and extends in a lateral direction to have an overlap region overlapping the first substrate and an extension region not overlapping the first substrate.

The antenna module may include a second patch antenna disposed above or within the extension region of the second substrate, and electrically connected to the IC.

The antenna module may include a dummy member disposed on a lower surface of the extension region of the second substrate, wherein an extension region of the second substrate may be bent toward a side surface of the two or more substrates.

The may include a first ground layer disposed between the second substrate and the first substrate, and may have a first through-hole surrounding the patch antenna.

The antenna module may include at least one feed via passing through the first through-hole, and electrically connected to the patch antenna, and a second ground layer spaced apart from the overlap region of the second substrate to be disposed on the first substrate, and having a second through-hole through which at least one of the at least one feed via passes, wherein an area of the at least one first through-holes may be larger than an area of the at least one second through-holes.

The antenna module may include shield vias disposed to electrically connect the first ground layer and the second ground layer, and arranged to surround the patch antenna.

The overlap region of the second substrate may be disposed between the patch antenna and the first substrate, and a dielectric constant of the first substrate may be lower than a dielectric constant of the second substrate.

The lowermost substrate comprises a wiring layer disposed between an insulating layer first and a second insulating layer, a wiring of the wiring layer electrically connecting the at least one feed via to the IC.

The antenna module may include a signal transmission line disposed in the extension region of the second substrate, and electrically connected to the IC.

The antenna module may include a second signal transmission line disposed in a second lateral extension region of the second substrate, and electrically connected to the IC, wherein the second lateral extension region may not overlap the first substrate and may include an extension of the second substrate in a second lateral direction.

The antenna module may include a second patch antenna disposed on an upper surface of a second lateral extension region of the second substrate, and electrically connected to the IC, wherein the second lateral extension region may not overlap the first substrate and may include an extension of the second substrate in a second lateral direction.

The antenna module may include a third substrate of the two or more substrates may be more flexible than the first substrate, and may extend in a lateral direction to have a second overlap region overlapping the first substrate and a second extension region may not overlapping the first substrate, and a second patch antenna disposed in a position above or within the second extension region of the third substrate, and the second patch antenna may be configured to transmit an RF signal to the IC or to receive an RF signal from the IC.

The second extension region of the third substrate may overlap at least a portion of the extension region of the second substrate.

The antenna module may include a second patch antenna disposed above or within the extension region of the second substrate, and transmitting an RF signal to the IC or receiving an RF signal from the IC, and a third ground layer may be disposed between the second patch antenna and the signal transmission line in the extension region of the second substrate.

The antenna module may include a first ground layer disposed between the second substrate and the first substrate, and may have a through-hole surrounding the patch antenna, at least one feed via may pass through the through-hole, and being electrically connected to the patch antenna, and shield vias disposed on an upper surface of the first ground layer and may be arranged to surround the patch antenna.

The antenna module may include a signal transmission line may be disposed in a position above or within the extension region of the second substrate, and a feed line may be disposed above or within the overlap region of the second substrate, and electrically connecting the patch antenna and the signal transmission line.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
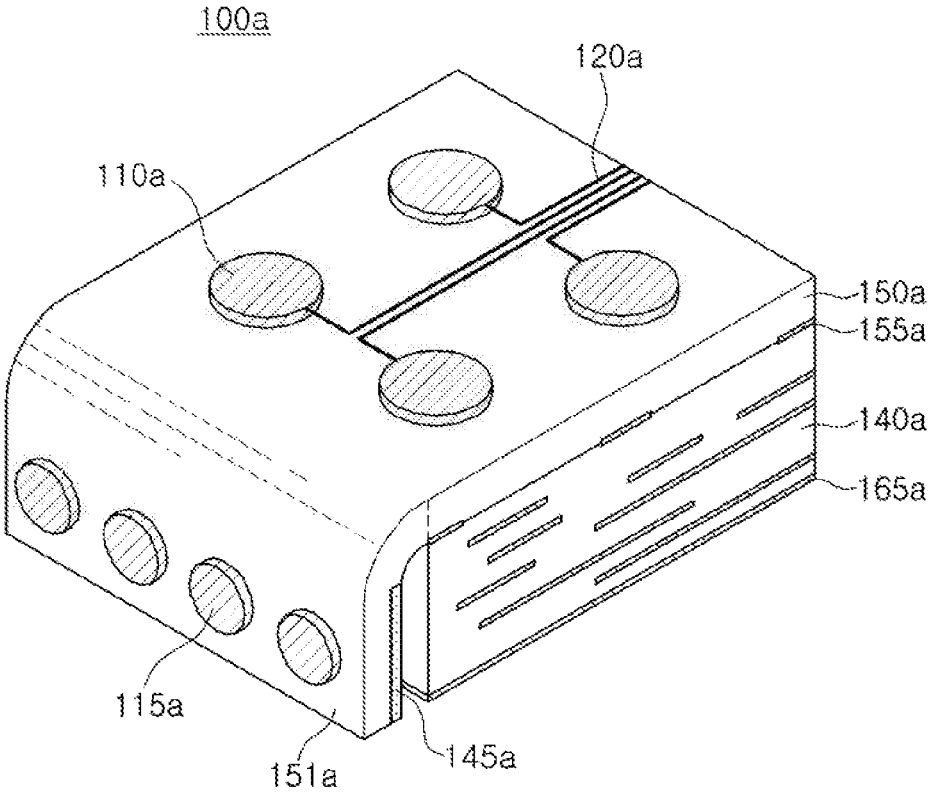
FIG. 1 is a diagram illustrating an example of a structure in which a second substrate of an antenna module is used as a space for arranging a second patch antenna.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

The terminology used herein is for describing various examples only, and is not to be used to limit the disclosure. As used herein, the term "and/or" includes any one and any combination of any two or more of the associated listed items. The articles "a," "an," and "the" are intended to include the plural forms as well, unless the context clearly indicates otherwise.

The use of the term "may" with respect to an example or embodiment, e.g., as to what an example or embodiment may include or implement, means that at least one example or embodiment exists in which such a feature is included or implemented while all examples and embodiments are not limited thereto.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

Due to manufacturing techniques and/or tolerances, variations of the shapes shown in the drawings may occur. Thus, the examples described herein are not limited to the specific shapes shown in the drawings, but include changes in shape that occur during manufacturing.

FIG. 1 is a diagram illustrating an example of a structure in which a second substrate of an antenna module that is used as a space for arranging a second patch antenna.

Figure 2A:
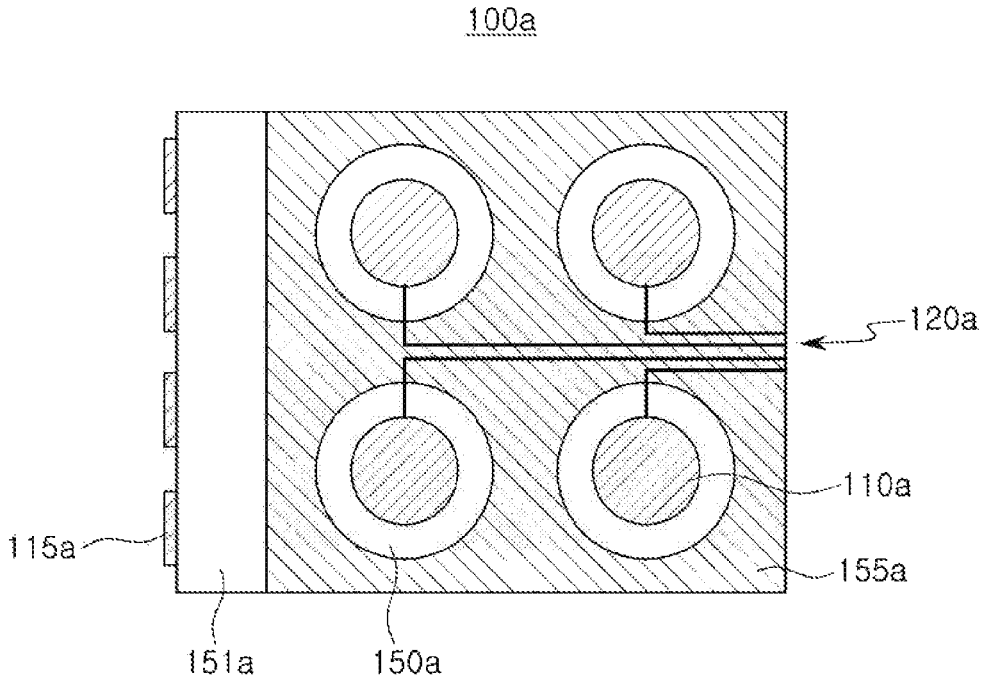
FIG. 2A is a diagram illustrating an example of the antenna module illustrated in FIG. 1.

FIG. 2A is a diagram illustrating an example of the antenna module illustrated in FIG. 1.

Figure 2B:
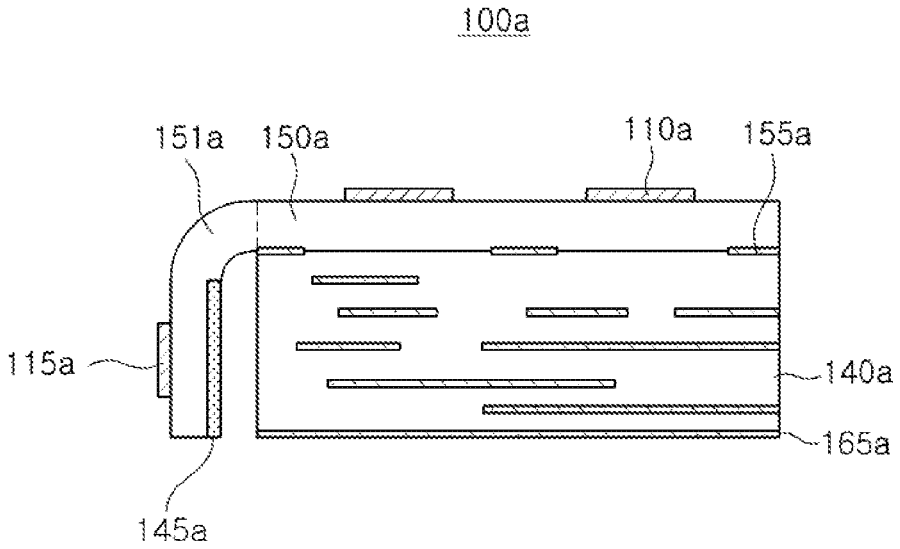
FIG. 2B is a diagram illustrating an example of the antenna module illustrated in FIG. 1.

FIG. 2B is a diagram illustrating an example of the antenna module illustrated in FIG. 1.

Referring to FIGS. 1, 2A, and 2B, an antenna module 100*a* may include at least a portion of a patch antenna 110*a*, a second patch antenna 115*a*, a first substrate 140*a*, and a second substrate 150*a*.

The patch antenna 110*a* may be disposed on an upper surface of the first substrate 140*a* and the second substrate 150*a*. In an example, the first substrate 140*a* and the second substrate 150*a* have insulation characteristics with a dielectric constant greater than that of air. For example, the first substrate 140*a* may include a dielectric layer formed of an FR4 or a low temperature co-fired ceramic (LTCC), and the second substrate 150*a* may include a liquid crystal polymer (LCP), but are not limited thereto. The material of the first substrate 140*a* and the second substrate 150*a* may vary depending on standards of design, such as, for example, flexibility, dielectric constant, ease of bonding between a plurality of substrates, durability, and cost.

The first substrate 140*a* may be designed to improve an antenna performance of the patch antenna 110*a*. For example, the first substrate 140*a* may have a dielectric constant less than a dielectric constant of the second substrate 150*a*. Therefore, since an effective wavelength of an RF signal passed through the first substrate 140*a* may be relatively long, an RF signal may be further concentrated in a direction toward an upper surface.

The second substrate 150*a* may be more flexible than the first substrate 140*a*. Since the first substrate 140*a* and the second substrate 150*a* adjacent to each other have different flexibility from each other, the first and second substrates 140*a* and 150*a* may be stacked to be distinguished from each other by a unit of flexibility.

The second substrate 150*a* may be more flexible than the first substrate 140*a* and may extend further than the first substrate 140*a* in a lateral direction. In an example, a region of the second substrate 150*a* may overlap the first substrate 140*a* and an extension region 151*a* of the second substrate may not overlap the first substrate 140*a*, when viewed in a vertical direction.

The patch antenna 110*a* may be configured to remotely receive an RF signal, and transmit the RF signal to the feed line 120*a*, or to receive an RF signal from the feed line 120*a*, and remotely transmit the RF signal. For example, the patch antenna 110*a* may have both surfaces having a circular or polygonal shape. Both surfaces of the patch antenna may function as a boundary through which an RF signal passes between a conductor and a non-conductor.

Therefore, the antenna module 100*a* may increase the number of the patch antennas 110*a* to increase the total area of boundaries through which RF signals are passed, and may improve a transmission/reception ratio and gain of RF signals. Also, a size of the antenna module 100*a* may increase, as the number of the patch antennas 110*a* increases.

The second patch antenna 115*a* may be configured to remotely receive an RF signal, and transmit the RF signal to the feed line 120*a*, or to receive an RF signal from the feed line 120*a*, and remotely transmit the RF signal, and may be disposed on an upper surface of the extension region 151*a* of the second substrate.

In an example example, the extension region 151*a* of the second substrate may provide a space for arranging the second patch antenna 115*a*. The extension region 151*a* of the second substrate may be flexible, and not overlap the first substrate 140*a*, when viewed in a vertical direction, and may be thus bent toward a side surface of the first substrate 140*a*. Therefore, since the antenna module 100*a* may more efficiently provide a space for arranging the patch antenna, an effective size of the antenna module 100*a* (e.g., an area of the antenna module, when viewed in a vertical direction) may be relatively reduced.

The second patch antenna 115*a* may remotely transmit and/or receive an RF signal in a different direction (e.g., a lateral direction) from the patch antenna 110*a*, as the extension region 151*a* of the second substrate is bent. For example, the antenna module 100*a* may expand an RF signal transmitting/receiving direction omnidirectionally by combining the patch antenna 110*a* and the second patch antenna 115*a*.

Referring to FIGS. 1, 2A, and 2B, an antenna module 100*a* includes at least a portion of a feed line 120*a*, a dummy member 145*a*, a first ground layer 155*a*, and a second ground layer 165*a*.

The first ground layer 155*a* may be disposed between the first substrate 140*a* and the second substrate 150*a*, and may include at least one first through-hole surrounding each of the at least one patch antenna 110*a*, when viewed in a vertical direction. Therefore, an RF signal that passes through the patch antenna 110*a* may be reflected in the first ground layer 155*a* to be further concentrated in a direction toward an upper surface. When the number of patch antennas 110*a* is present in more than one, the first ground layer 155*a* may improve a degree of isolation between adjacent patch antennas 110*a*.

The second ground layer 165*a* may be disposed at a lower end of the first substrate 140*a*. The second ground layer 165*a* may reflect an RF signal that passed through the patch antenna 110*a* to further concentrate the RF signal in a direction toward an upper surface. Therefore, RF signal transmission/reception performance of the patch antenna 110*a* may be further improved.

The feed line 120*a* may transfer an RF signal received from the patch antenna 110*a* and/or the second patch antenna 115*a* to the IC, and may transfer an RF signal received from the IC to the patch antenna 110*a* and/or the second patch antenna 115*a*.

For example, one end of the feed line 120*a* may be connected to the patch antenna 110*a* and/or a side surface of the second patch antenna 115*a*, and the other end of the feed line 120*a* may be connected to a feed via and/or a signal transmission line. Therefore, the feed line 120*a* may electrically connect the IC to the patch antenna 110*a* and/or the second patch antenna 115*a* without crossing the second ground layer 165*a*. The feed line 165*a* may not have a separate through-hole for passing through the feed line 120*a*. Therefore, an RF signal passed through the patch antenna 110*a* may be further concentrated in a direction toward an upper surface.

The dummy member 145*a* may be disposed on a lower surface of the extension region 151*a* of the second substrate. When the extension region 151*a* of the second substrate is bent, the dummy member 145*a* may be disposed between the extension region 151*a* of the second substrate and the side surface of the first substrate 140*a*. Therefore, a physical/electromagnetic collision between the extension region 151*a* of the second substrate and the first substrate 140*a* may be prevented, and positional stability of the second patch antenna 115*a* may be improved to prevent a reduction in beamforming efficiency of the antenna module 100*a*.

Figure 3A:
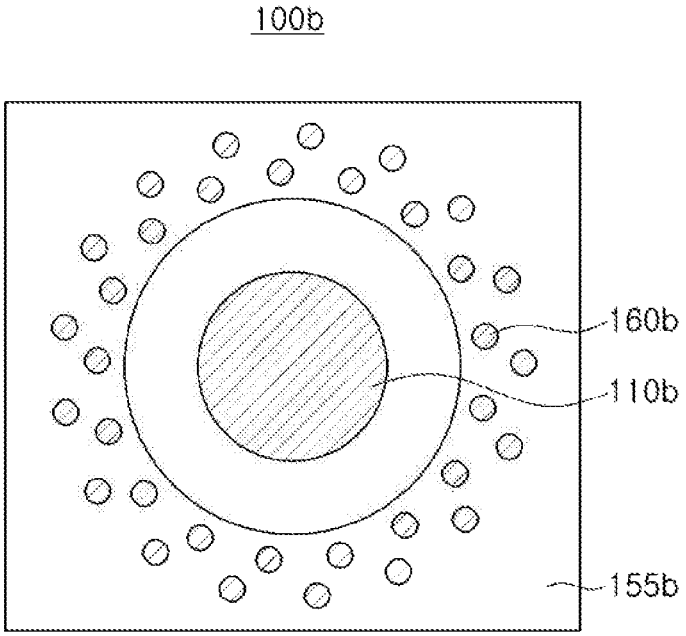
FIG. 3A is a diagram illustrating an example of a feed via connection structure and a shield via in an antenna module.

FIG. 3A is a diagram illustrating an example of a feed via connection structure and a shield via in an antenna module.

Figure 3B:
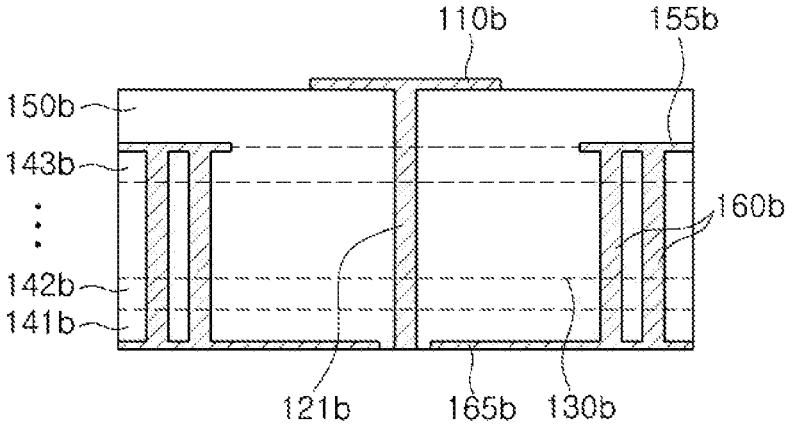
FIG. 3B is a diagram illustrating an example of a feed via connection structure and a shield via in an antenna module.

FIG. 3B is a diagram illustrating an example of a feed via connection structure and a shield via in an antenna module.

Referring to FIGS. 3A and 3B, an antenna module 100*b* may include at least a portion of a patch antenna 110*b*, a feed via 121*b*, a plurality of first substrates 141*b*, 142*b*, and 143*b*, a second substrate 150*b*, a first ground layer 155*b*, a plurality of shield vias 160*b*, and a second ground layer 165*b*. One or more of the components included in the antenna module 100*b* may have characteristics similar to the corresponding components illustrated in FIG. 1. In addition to the description of FIGS. 3A and 3B below, the descriptions of FIGS. 1-2B are also applicable to FIGS. 3A and 3B, and are incorporated herein by reference. Thus, the above description may not be repeated here.

The feed via 121*b* may be disposed to pass through the plurality of first substrates 141*b*, 142*b*, and 143*b*, and the second substrate 150*b*, and may electrically connect the patch antenna 110*b* and the IC. The feed via 121*b* may reduce an electrical length between the patch antenna 110*b* and the IC, thereby reducing a transmission loss of an RF signal. For example, the feed via 121*b* may have a structure of a through via, or may have a structure in which a plurality of vias are connected in series.

The plurality of shield vias 160*b* may be disposed to electrically connect the first ground layer 155*b* and the second ground layer 165*b*, and may be arranged to surround the patch antenna 110*b*, when viewed in a vertical direction.

An area surrounded by the plurality of shield vias 160*b* in the plurality of first substrates 141*b*, 142*b*, and 143*b* may form a dielectric cavity 130*b*. The dielectric cavity 130*b* may reflect RF signals leaked onto a side surface or a lower surface to guide the RF signals to the patch antenna 110*b* or in a direction toward an upper surface. Therefore, a transmission/reception ratio and gain of the patch antenna 110*b* may be improved, and a degree of isolation between the plurality of patch antennas may also be improved.

For example, an area of the dielectric cavity 130*b* in a lateral direction, formed by the plurality of shield vias 160*b*, may be larger than an area of the through-hole of the first ground layer 155*b*. Therefore, the dielectric cavity 130*b* may further concentrate an RF signal passed through the patch antenna 110*b* in a direction toward an upper surface.

A portion of the plurality of shield vias 160*b* may be disposed adjacent to the dielectric cavity 130*b* relatively, and the rest of the plurality of shield vias 160*b* may be disposed to cover a gap between the portions of the plurality of shield vias 160*b*. Therefore, reflection performance of an RF signal of the plurality of shield vias 160*b* may be further improved.

Figure 4:
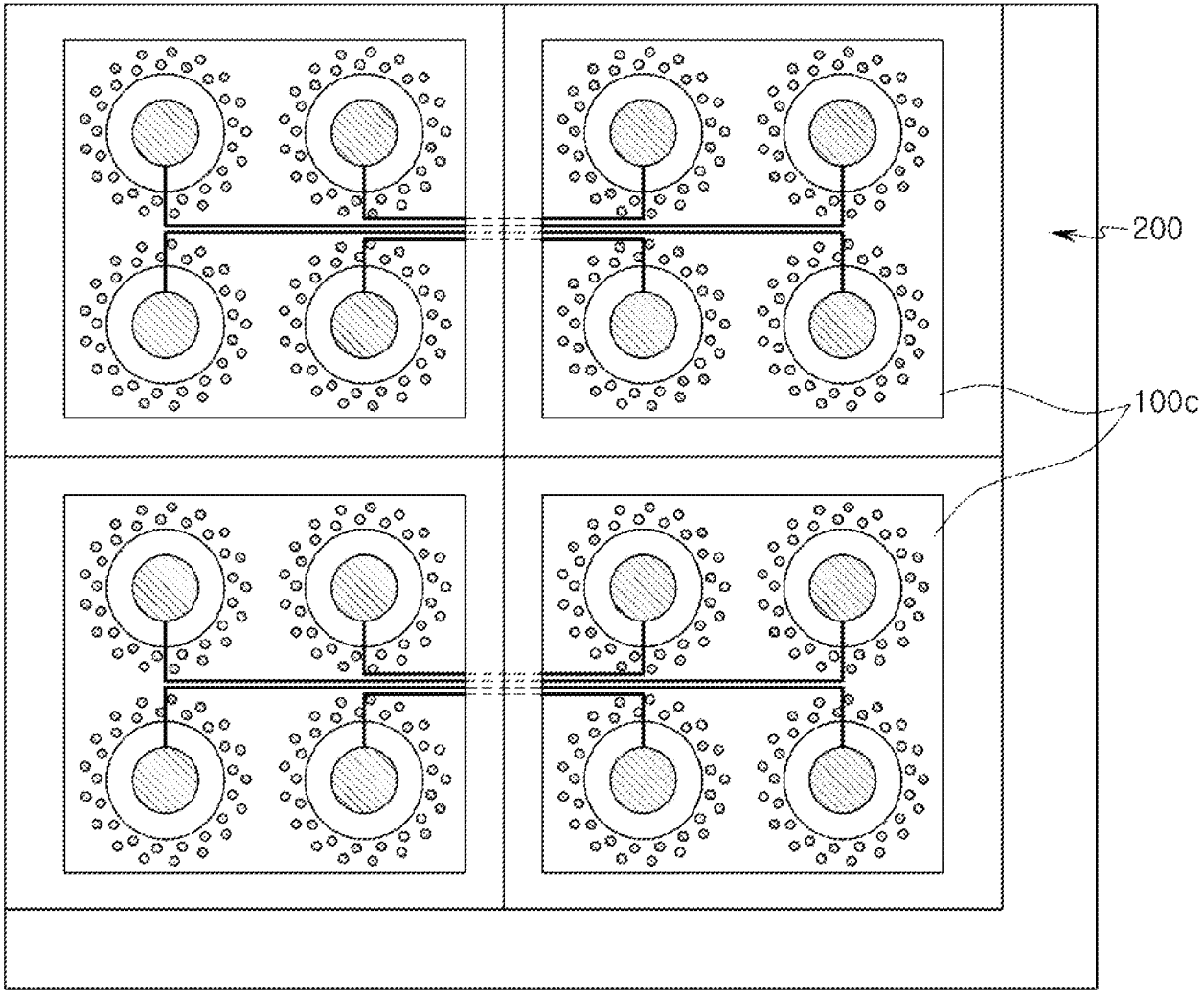
FIG. 4 is a diagram illustrating an example of an expanded structure according to an increase in the number of patch antennas of an antenna module.

FIG. 4 is a diagram illustrating an example of an expanded structure according to an increase in the number of patch antennas of an antenna module.

Referring to FIG. 4, the number (for example, sixteen (16)) of patch antennas of an antenna module 100*c* is greater than the number (for example, four (4)) of the patch antennas illustrated in FIGS. 1 to 3B.

The plurality of patch antennas may integrally form a beam toward an upper end. The efficiency of integrated beamforming of the plurality of patch antennas may vary depending on a polarization relationship of a plurality of RF signals passed through each of the plurality of patch antennas, a positional relationship and a size relationship between the plurality of patch antennas.

Each of one ends of a plurality of feed lines may be respectively connected to each of the plurality of patch antennas, and the other end of the plurality of feed lines may be concentrated to a center of the antenna module 100*c*, and may be electrically connected to a feed via.

A second substrate 200 may extend in a first lateral direction (e.g., a six (6) o'clock direction) and a second lateral direction (e.g., a nine (9) o'clock direction) of the antenna module 100*c*.

Figure 5A:
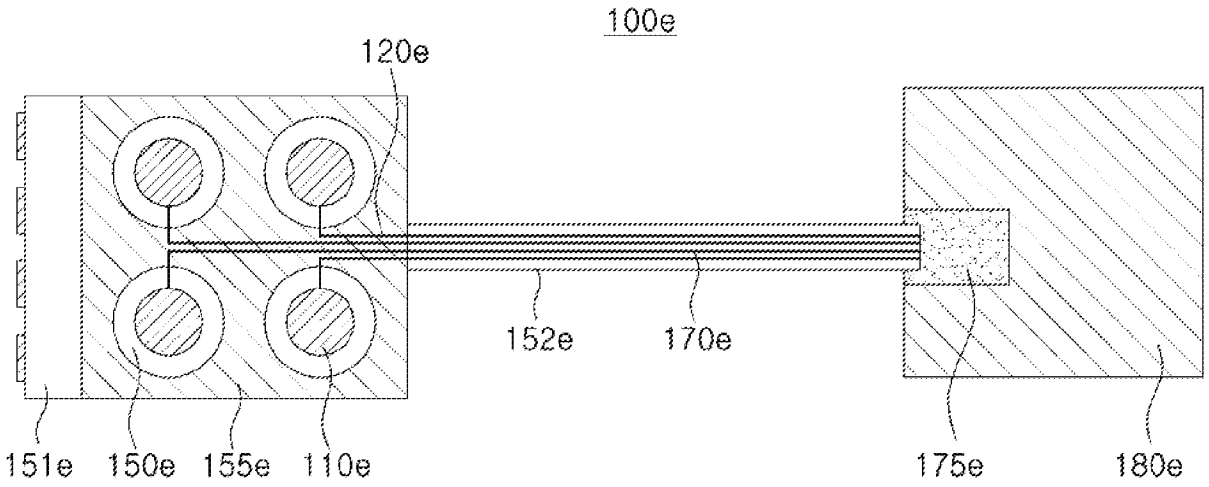
FIG. 5A is a diagram illustrating an example of a structure in which a second substrate of an antenna module is used as a space for arranging a signal transmission line.

FIG. 5A is a diagram illustrating an example of a structure in which a second substrate of an antenna module is used as a space for arranging a signal transmission line.

Figure 5B:
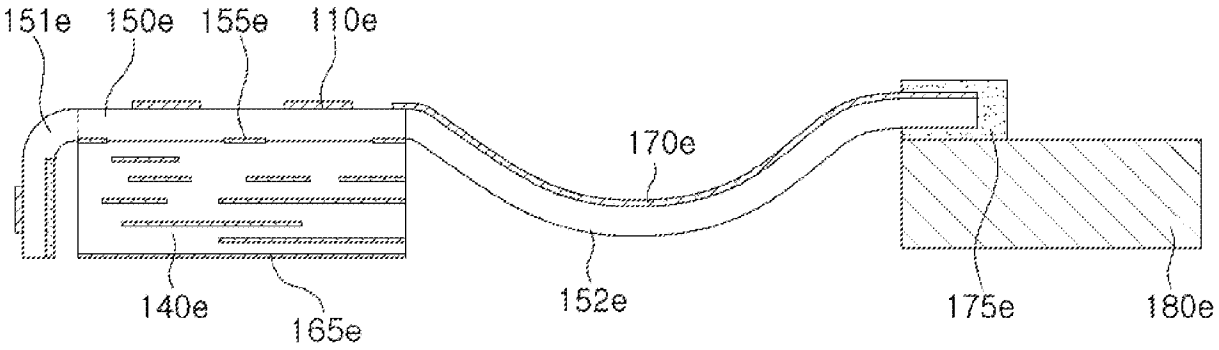
FIG. 5B is a diagram illustrating an example of the antenna module illustrated in FIG. 5A.

FIG. 5B is a diagram illustrating an example of the antenna module illustrated in FIG. 5A.

Referring to FIGS. 5A and 5B, an antenna module 100*e* may include at least a portion of a patch antenna 110*e*, a second patch antenna 115*e*, a feed line 120*e*, a first substrate 140*e*, a second substrate 150*e*, a first ground layer 155*e*, a second ground layer 165*e*, and a signal transmission line 170*e*. One or more of the components included in the antenna module 100*e* may have characteristics similar to the corresponding components illustrated in FIG. 1. In addition to the description of FIGS. 5A and 5B below, the descriptions of FIGS. 1-4 are also applicable to FIGS. 5A and 5B, and are incorporated herein by reference. Thus, the above description may not be repeated here.

The second substrate 150*e* has an overlap region of the second substrate overlapping the first substrate 140*e*, an extension region 151*e* of the second substrate that does not overlap the first substrate 140*e*, and an extension region 152*e* of the second substrate that does not overlap the first substrate 140*e*, when viewed in a vertical direction.

The signal transmission line 170*e* may be disposed in the extension region 152*e* of the second substrate, and one end of the signal transmission line 170*e* may be electrically connected to an IC and/or the patch antenna 110*e*.

When the other end of the signal transmission line 170*e* is disposed in a connector 175*e* of a set substrate 180*e*, the signal transmission line 170*e* may provide an electrical path to the set substrate 180*e* of the antenna module 100*e*.

In an example, the extension region 152*e* of the second substrate is flexible, and does not overlap the first substrate 140*e*, when viewed in a vertical direction. Therefore, the extension region 152*e* of the second substrate may be bent flexibly, in conformity with positions of the connector 175*e* and the set substrate 180*e*.

Therefore, an antenna module 100*e* may be further simplified, since a separate component for electrically connecting to the connector 175*e* and the set substrate 180*e* is not needed.

In addition, an antenna module 100*e* may reduce limitations of a space for arranging the antenna module 100*e* according to positions of the connector 175*e* and the set substrate 180*e*, such as, for example, transmission/reception ratio, gain, directivity, and direction.

Depending on a design, the feed line 120*e* may be disposed in the overlap region of the second substrate 150*e*, and electrically connect the patch antenna 110*e* and/or the second patch antenna 115*e* to the signal transmission line 170*e*. For example, the signal transmission line 170*e* may be used as a transmission path of an RF signal. Therefore, since an antenna module 100*e* does not include an IC that performs conversion between an IF signal or a baseband signal and an RF signal, the antenna module 100*e* may be further miniaturized, or may be designed to be more in line with improved antenna performance of the patch antenna 110*e*.

Figure 6A:
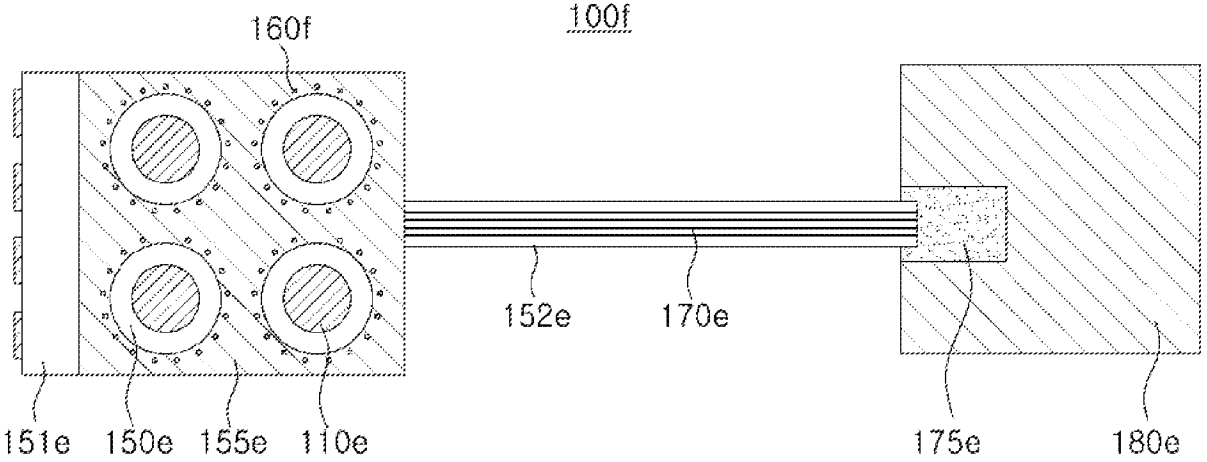
FIG. 6A is a diagram illustrating an example of a structure in which a second substrate of an antenna module is used as a space for arranging a signal transmission line.

FIG. 6A is a diagram illustrating an example of a structure in which a second substrate of an antenna module is used as a space for arranging a signal transmission line.

Figure 6B:
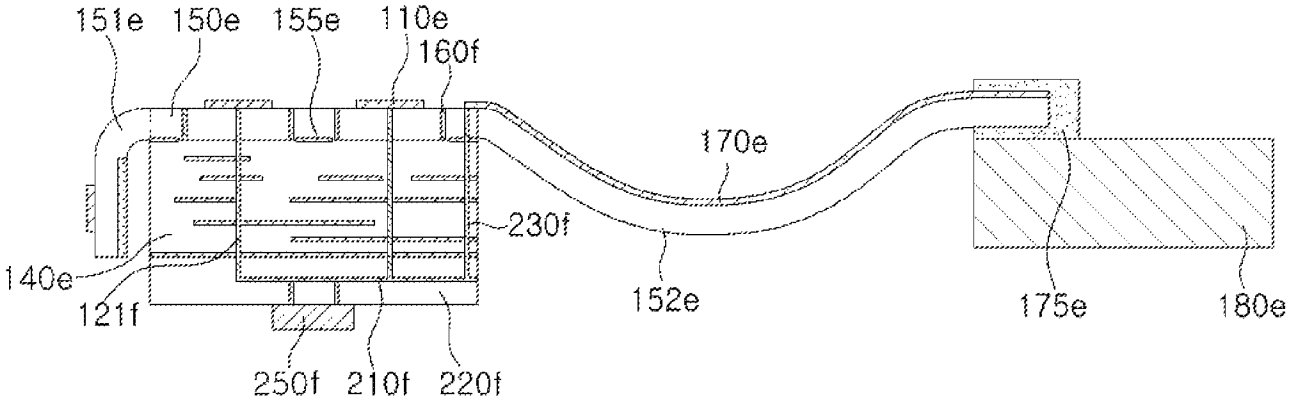
FIG. 6B is a diagram illustrating an example of the antenna module illustrated in FIG. 6A.

FIG. 6B is a diagram illustrating an example of the antenna module illustrated in FIG. 6A.

Referring to FIGS. 6A and 6B, an antenna module 100*f* may include at least a portion of a feed via 121*f*, a plurality of shield vias 160*f*, a wiring layer 210*f*, an insulating layer 220*f*, a wiring via 230*f*, and an IC 250*f*. At least a portion of the plurality of components included in the antenna module 100*f* may have characteristics similar to the corresponding components illustrated in FIGS. 3A and 3B. In addition to the description of FIGS. 6A and 6B below, the descriptions of FIGS. 1-5B are also applicable to FIGS. 6A and 6B, and are incorporated herein by reference. Thus, the above description may not be repeated here.

A plurality of substrates on which a first substrate 140*e* and a second substrate 150*e* are stacked may further include a wiring layer 210*f* and an insulating layer 220*f*, stacked on a lower surface of the first substrate 140*e* and the second substrate 150*e*.

The IC 250*f* may be disposed on a lower surface of the first substrate 140*e* and the second substrate 150*e*. In an example, an upper surface of the IC 250*f* is an active surface on which a plurality of connection pads are disposed, and a lower surface of the IC 250*f* is an inactive surface. The IC 250*f* may have a structure in which the plurality of connection pads are electrically connected to a plurality of electrical connection structures (e.g., solder balls, bumps) on lower surfaces of the plurality of substrates. The plurality of electrical connection structures may be electrically connected to corresponding wirings of the wiring layer 210*f*.

One end of the feed via 121*f* may be electrically connected to the patch antenna 110*e*, and the other end of the feed via 121*f* may be electrically connected to the corresponding wiring of the wiring layer 210*f*. Therefore, the IC 250*f* may receive an RF signal from the patch antenna 110*e*, or may transmit an RF signal to the patch antenna 110*e*.

The IC 250*f* may convert a radio frequency (RF) signal into an intermediate frequency (IF) signal or a baseband signal, and may convert an IF signal or a baseband signal into an RF signal. The IC 250*f* may transmit an IF signal or a baseband signal to the signal transmission line 170*e* through the wiring layer 210*f* and the wiring via 230*f*, or may receive an IF signal or a baseband signal from the signal transmission line 170*e*.

In an example, the IF signal or the baseband signal transferred through the signal transmission line 170*e* is transmitted to an intermediate frequency integrated circuit (IFIC) or a baseband integrated circuit (BBIC) of a set substrate 180*e* through a connector 175*e*.

Shield vias 160*f* are disposed on an upper surface of a first ground layer 155*e* to be electrically connected to the first ground layer 155*e*, and may be arranged to surround at least one patch antenna 110*e*, when viewed in a vertical direction. Therefore, an electromagnetic isolation between the patch antenna 110*e* and the signal transmission line 170*e* may be improved, and a noise of the signal transmission line 170*e* due to the RF signal transmission and reception of the patch antenna 110*e* may be relatively reduced.

Figure 7A:
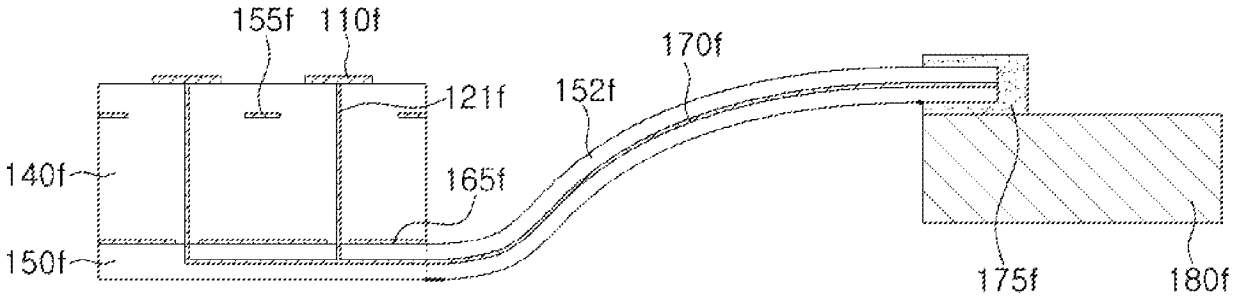
FIG. 7A is a diagram illustrating an example of a structure in which a second substrate of an antenna module is disposed on a lower surface of a first substrate and is used as a space for arranging a signal transmission line.

FIG. 7A is a diagram illustrating an example of a structure in which a second substrate of an antenna module is disposed on a lower surface of a first substrate and is used as a space for arranging a signal transmission line.

Referring to FIG. 7A, an antenna module may include at least a portion of a patch antenna 110*f*, a feed via 121*f*, a first substrate 140*f*, a second substrate 150*f*, a first ground layer 155*f*, a second ground layer 165*f*, and a signal transmission line 170*f*. At least a portion of the plurality of components included in the antenna module may have characteristics similar to the corresponding components illustrated in FIGS. 5A to 6B. In addition to the description of FIG. 7A below, the descriptions of FIGS. 1-6B are also applicable to FIG. 7A, and are incorporated herein by reference. Thus, the above description may not be repeated here.

A second substrate 150*f* may be disposed on a lower surface of a first substrate 140*f*. The second substrate 150*f* may extend in a lateral direction from the first substrate 140*f* to have an overlap region of the second substrate overlapping the first substrate 140*f* and an extension region 152*f* of the second substrate that does not overlap the first substrate 140*f*, when viewed in a vertical direction.

A signal transmission line 170*f* may be disposed in the extension region 152*f* of the second substrate, and may electrically connect a connector 175*f* of a set substrate 180*f* and a feed via 121*f*. The feed via 121*f* may electrically connect a patch antenna 110*f* and the signal transmission line 170*f*.

For example, the signal transmission line 170*f* may provide a transmission path of the RF signal. In an example, a power management integrated circuit (PMIC) or a passive component (e.g., a multilayer ceramic capacitor, an inductor, a chip resistor, etc.) may be disposed on lower surfaces of the plurality of substrates, and an IC performing conversion of an RF signal may be disposed on a set substrate 180*f*.

Figure 7B:
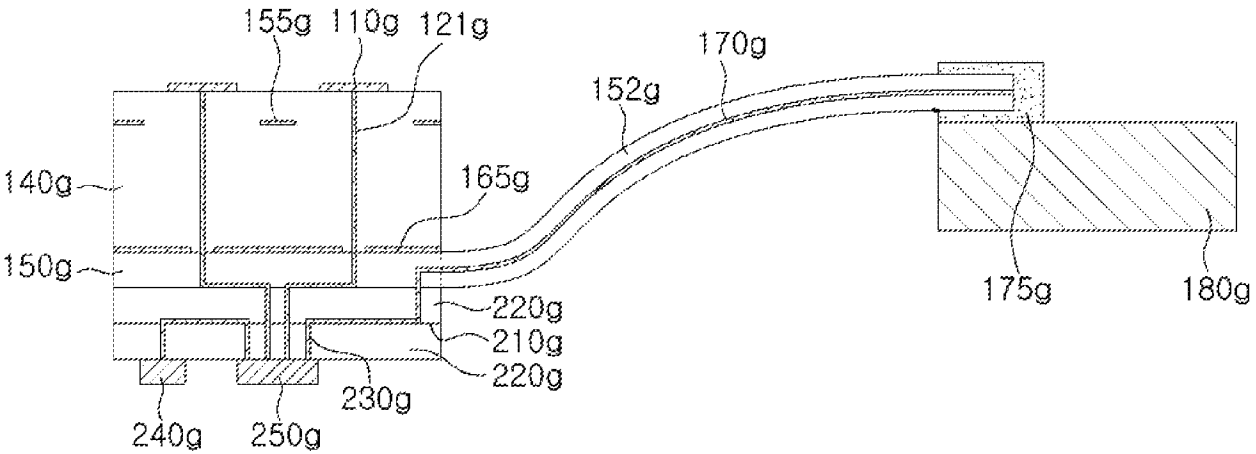
FIG. 7B is a diagram illustrating an example of first and second insulating layers and a wiring layer arranged on a lower surface of a second substrate of an antenna module.

FIG. 7B is a diagram illustrating an example of first and second insulating layers and a wiring layer arranged on a lower surface of a second substrate of an antenna module.

Referring to FIG. 7B, an antenna module may include at least a portion of a patch antenna 110*g*, a feed via 121*g*, a first substrate 140*g*, a second substrate 150*g*, a first ground layer 155*g*, a second ground layer 165*g*, a signal transmission line 170*g*, a wiring layer 210*g*, an insulating layer 220*g*, a wiring via 230*g*, a chip antenna 240*g*, and an IC 250*g*. At least a portion of the plurality of components included in the antenna module may have characteristics similar to the corresponding components illustrated in FIGS. 5A to 6B. In addition to the description of FIG. 7B below, the descriptions of FIGS. 1-7A are also applicable to FIG. 7B, and are incorporated herein by reference. Thus, the above description may not be repeated here.

In an example, the second substrate 150*g* is disposed on a lower surface of the first substrate 140*g*. The wiring layer 210*g* and the insulating layer 220*g* may be arranged on a lower surface of an overlap region of the second substrate 150*g*. The wiring layer 210*g* and the insulating layer 220*g* may be defined as a third substrate. Since the first substrate 140*g* and the second substrate 150*g* adjacent to each other have different flexibility, and the second substrate 150*g* and the third substrate adjacent to each other have different flexibility, the first substrate 140*g* and the second substrate 150*g* and the third substrate have a structure in which they are stacked to be distinguished from each other by a unit of flexibility.

An extension region 152*g* of the second substrate may extend to a connector 175*g* of a set substrate 180*g*. A signal transmission line 170*g* may be disposed on the extension region 152*g*.

The IC 250*g* may transmit an IF signal or a baseband signal to the signal transmission line 170*g*, and may receive an IF signal or a baseband signal from the signal transmission line 170*g*, through the wiring layer 210*g* and the wiring via 230*g*. The IC 250*g* may transmit an RF signal to the patch antenna 110*g*, or may receive an RF signal from the patch antenna 110*g*, through the wiring layer 210*g* and the feed via 121*g*.

The extension region 152*g* of the second substrate may have a high degree of isolation with respect to the patch antenna 110*g* due to the first and second ground layers 155*g* and 165*g*. Therefore, electromagnetic noise provided to the signal transmission line 170*g* by the patch antenna 110*g* may be relatively reduced. In addition, the patch antenna 110*g* may easily have a structure for improving antenna performance without substantial consideration of the signal transmission line 170*g* due to the first substrate 140*g*.

Meanwhile, the chip antenna 240*g* may be disposed on the lower surfaces of the plurality of substrates, and may transmit and receive RF signals in a lateral direction. For example, the chip antenna 240*g* may include a first electrode, a second electrode, and a dielectric. The dielectric may be disposed between the first and second electrodes, and may have a dielectric constant greater than that of the first and second substrates 140*g* and 150*g*. The first electrode may be electrically connected to the corresponding wiring of the wiring layer 210*g*, and the second electrode may be electrically connected to a ground pattern of the wiring layer 210*g*.

Figure 7C:
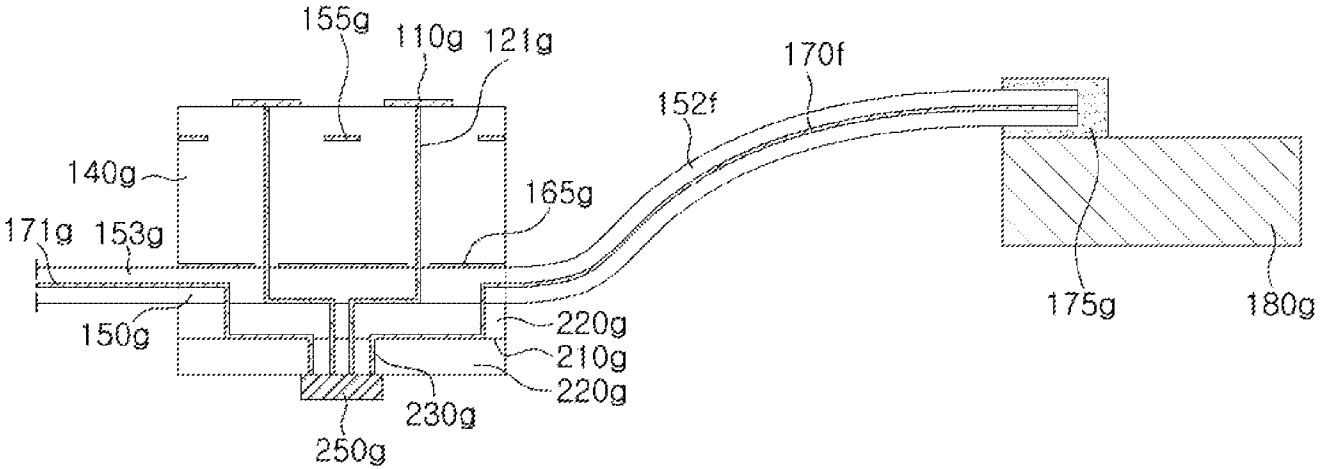
FIG. 7C is a diagram illustrating an example of a structure in which a second substrate of an antenna module extends in a second lateral direction and is used as a space for arranging a second signal transmission line.

FIG. 7C is a diagram illustrating an example of a structure in which a second substrate of an antenna module extends in a second lateral direction and is used as a space for arranging a second signal transmission line.

Referring to FIG. 7C, an antenna module may further include a second signal transmission line 171*g*.

A second substrate 150*g* may extend to a second side surface to have a second lateral extension region 153*g* of the second substrate not overlapping a first substrate 140*g*, when viewed in a vertical direction. The second signal transmission line 171*g* may be disposed on the second lateral extension region 153*g* of the second substrate, and one end of the second signal transmission line 171*g* may be electrically connected to an IC 250*g*.

For example, the second lateral extension region 153*g* of the second substrate may extend to a second antenna module. For example, the other end of the second signal transmission line 171*g* may be electrically connected to an antenna disposed in the second antenna module. The antenna disposed in the second antenna module may perform beamforming together with a patch antenna 110*g*. The second lateral extension region 153*g* of the second substrate may be more flexible than the first substrate 140*g*, and may not overlap the first substrate 140*g*, when viewed in a vertical direction. Therefore, the antenna disposed in the second antenna module and the patch antenna 110*g* may more effectively form beamforming, or more efficiently form a radiation pattern omnidirectionally.

For example, the second lateral extension region 153*g* of the second substrate may extend to a module in which a PMIC and/or a passive component are disposed. Therefore, the antenna module may omit a space for arranging the PMIC and/or the passive component, such that a size of the antenna module may be further reduced. Also, the antenna module may not be subject to practical arrangement constraints of the antenna module due to an external use of the PMIC and/or the passive component.

Figure 7D:
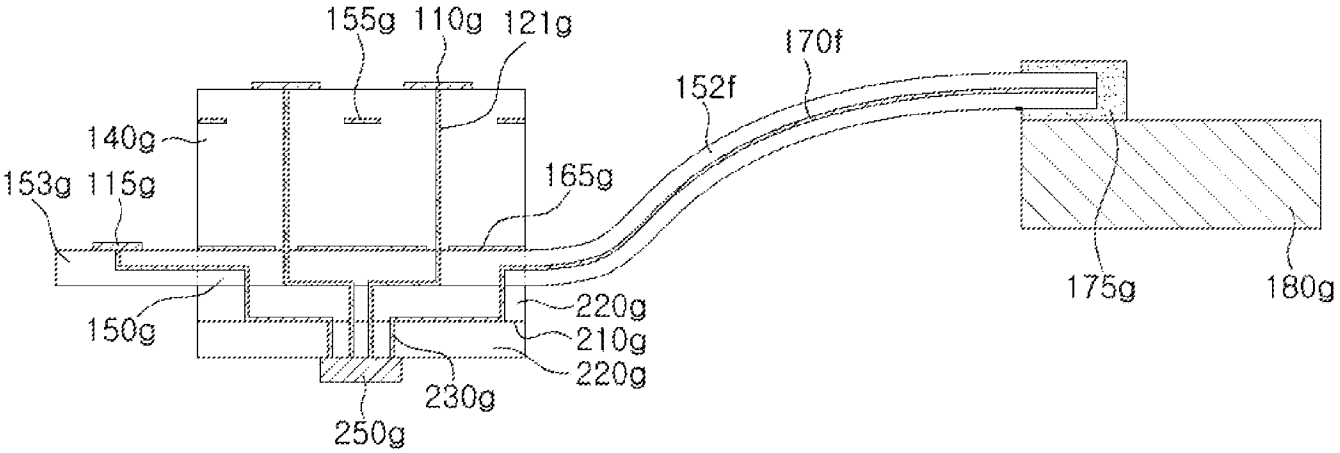
FIG. 7D is a diagram illustrating an example of a structure in which a second substrate of an antenna module extends in a second lateral direction and is used as a space for arranging a second patch antenna.

FIG. 7D is a diagram illustrating an example of a structure in which a second substrate of an antenna module extends in a second lateral direction and is used as a space for arranging a second patch antenna.

Referring to FIG. 7D, an antenna module may include a second patch antenna 115*g* disposed on an upper surface of a second lateral extension region 153*g* of a second substrate.

The second lateral extension region 153*g* of the second substrate may be bent toward the side surfaces of the wiring layer 210*g* and the insulating layer 220*g*, such that the antenna module may be formed to have an increase in size, and may also transmit and receive RF signals in a second lateral direction.

Figure 7E:
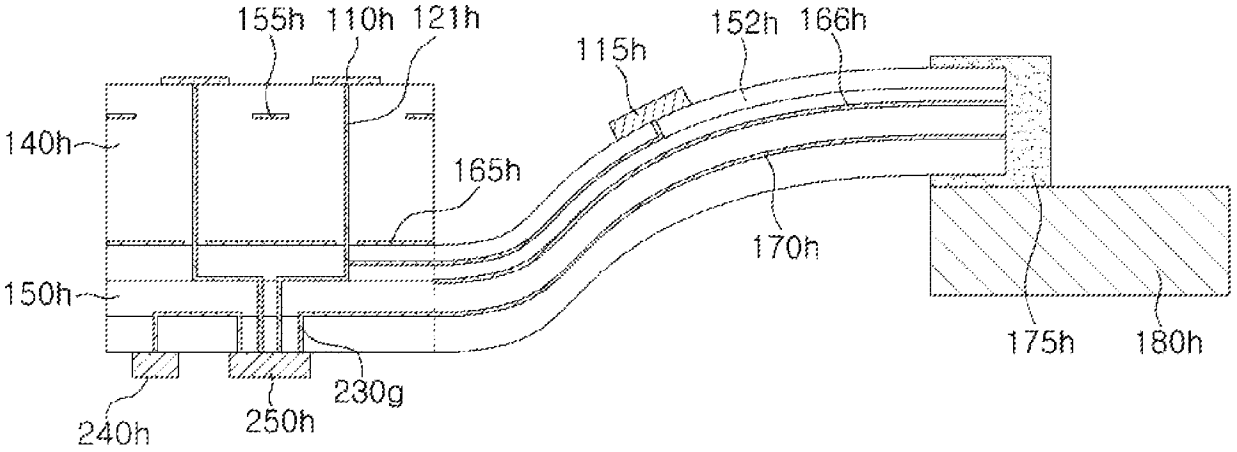
FIG. 7E is a diagram illustrating an example of a structure in which a second substrate of an antenna module is used as a space for arranging both a signal transmission line and a second patch antenna.

FIG. 7E is a diagram illustrating an example of a structure in which a second substrate of an antenna module is used as a space for arranging both a signal transmission line and a second patch antenna.

Referring to FIG. 7E, an antenna module may include at least a portion of a patch antenna 110*h*, a second patch antenna 115*h*, a feed via 121*h*, a first substrate 140*h*, a second substrate 150*h*, a first ground layer 155*h*, a second ground layer 165*h*, a third ground layer 166*h*, a signal transmission line 170*h*, a wiring via 230*h*, a chip antenna 240*h*, and an IC 250*h*. At least a portion of the plurality of components included in the antenna module may have characteristics similar to the corresponding components illustrated in FIG. 7B. In addition to the description of FIG. 7E below, the descriptions of FIGS. 1-7D are also applicable to FIG. 7E, and are incorporated herein by reference. Thus, the above description may not be repeated here.

The second substrate 150*h* may extend in a lateral direction to have an extension region 152*h* of the second substrate not overlapping the first substrate 140*h*, when viewed in a vertical direction.

The second patch antenna 115*h* may be disposed on the extension region 152*h* of the second substrate. The signal transmission line 170*h* may be disposed in the extension region 152*h* of the second substrate, and may be electrically connected to a connector 175*h* of a set substrate 180*h*.

In addition, the third ground layer 166*h* may be disposed between the second patch antenna 115*h* and the signal transmission line 170*h* in the extension region 152*h* of the second substrate. Therefore, the second patch antenna 115*h* may improve a degree of isolation of the signal transmission line 170*h* while further concentrating an RF signal in a direction toward an upper surface, and the signal transmission line 170*h* may reduce electromagnetic noise caused by transmission and reception of RF signals of the second patch antenna 115*h*.

Figure 8A:
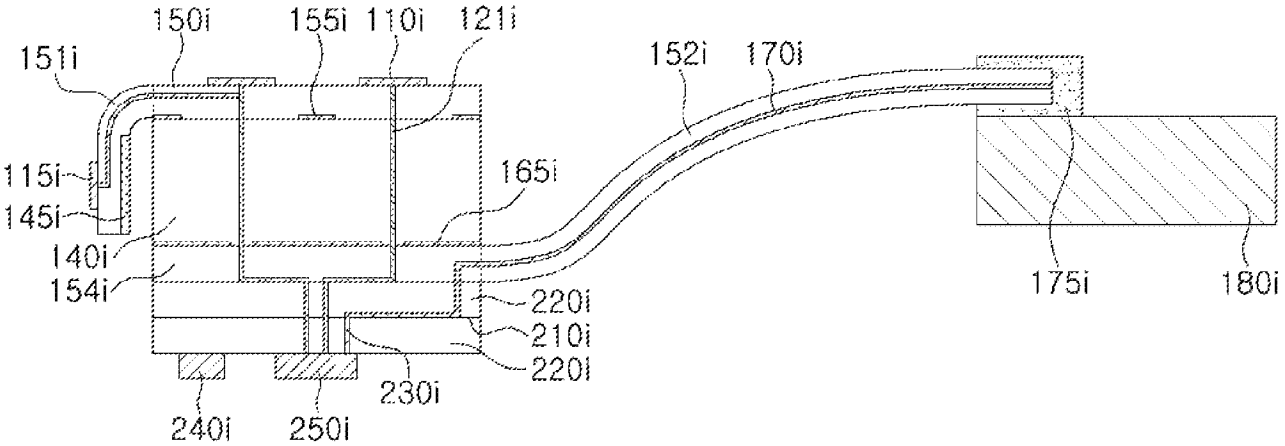
FIG. 8A is a diagram illustrating an example of a structure in which a third substrate is stacked in an antenna module.

FIG. 8A is a diagram illustrating an example of a structure in which a third substrate is stacked in an antenna module.

Referring to FIG. 8A, an antenna module may include at least a portion of a patch antenna 110*i*, a second patch antenna 115*i*, a feed via 121*i*, a first substrate 140*i*, a dummy member 145*i*, a second substrate 150*i*, a third substrate 154*i*, a first ground layer 155*i*, a second ground layer 165*i*, a signal transmission line 170*i*, a wiring layer 210*i*, an insulating layer 220*i*, a wiring via 230*i*, a chip antenna 240*i*, and an IC 250*i*. At least a portion of the plurality of components included in the antenna module may have characteristics similar to the corresponding components illustrated in FIG. 7B. In addition to the description of FIG. 8A below, the descriptions of FIGS. 1-7E are also applicable to FIG. 8A, and are incorporated herein by reference. Thus, the above description may not be repeated here.

The second substrate 150*i* may be disposed on an upper surface of the first substrate 140*i*, and the third substrate 154*i* may be disposed on a lower surface of the first substrate 140*i*. The wiring layer 210*i* and the insulating layer 220*i* may be disposed on a lower surface of the third substrate 154*i*. Since the first substrate 140*i* and the second substrate 150*i* adjacent to each other have different flexibility from each other, and the first substrate 140*i* and the third substrate 154*i* adjacent to each other have different flexibility from each other, the first, second, and third substrates 140*i*, 150*i*, and 154*i* may have a structure stacked to be distinguished from each other by a unit of flexibility.

The second substrate 150*i* may extend in a first lateral direction to have an extension region 151*i* of the second substrate not overlapping the first substrate 140*i*, when viewed in a vertical direction. The third substrate 154*i* may extend in a second lateral direction to have an extension region 152*i* of the third substrate not overlapping the first substrate 140*i*, when viewed in a vertical direction.

The second patch antenna 115*i* may be disposed on an upper surface of the extension region 151*i* of the second substrate, and the signal transmission line 170*i* may be disposed on the extension region 152*i* of the third substrate.

Since the extension region 151*i* of the second substrate and the extension region 152*i* of the third substrate have a high degree of isolation with respect to each other due to the first and second ground layers 155*i* and 165*i*, and a degree of isolation between the second patch antenna 115*i* and the signal transmission line 170*i* may be improved.

Figure 8B:
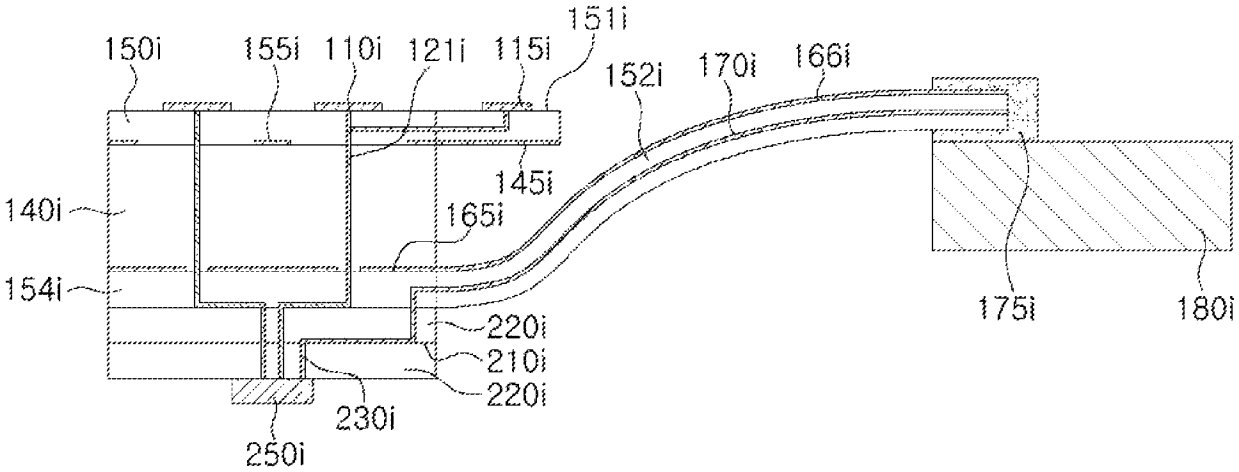
FIG. 8B is a diagram illustrating an example of a structure in which an extension region of a second substrate and an extension region of a third substrate overlap each other in an antenna module.

FIG. 8B is a diagram illustrating an example of a structure in which an extension region of a second substrate and an extension region of a third substrate overlap each other in an antenna module.

Referring to FIG. 8B, an extension region 152*i* of a third substrate may be arranged to overlap at least a portion of an extension region 151*i* of a second substrate, when viewed in a vertical direction. In addition, a third ground layer 166*i* may be disposed in the extension region 152*i* of the third substrate to be positioned between the extension region 151*i* of the second substrate and a signal transmission line 170*i*. Therefore, a degree of isolation between a second patch antenna 115*i* and the signal transmission line 170*i* may be improved.

In addition, an antenna module may increase the effective size of the antenna module by using a space more efficiently, as an overlap area between the extension region 151*i* of the second substrate and the extension region 152*i* of the third substrate is larger.

Figure 9:
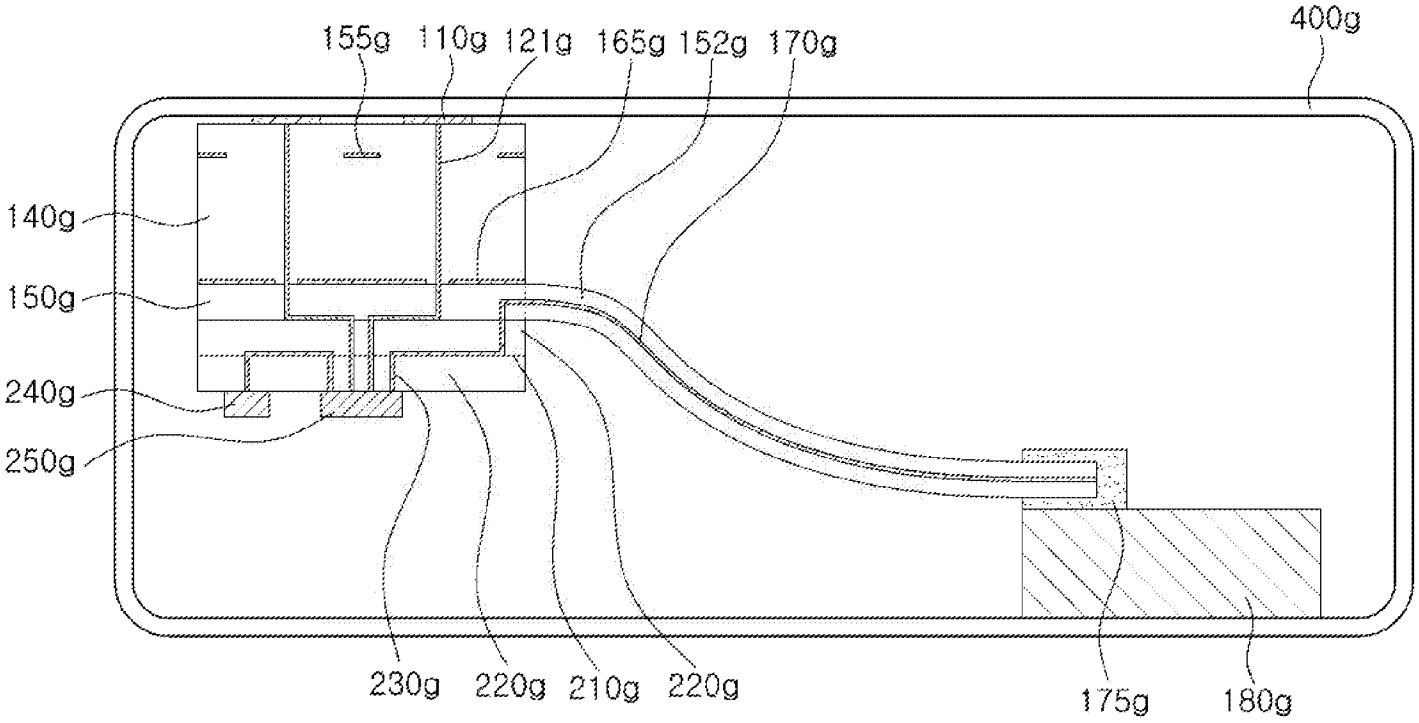
FIG. 9 is a diagram illustrating an example of a structure in which an antenna module is disposed in an electronic device.

FIG. 9 is a diagram illustrating an example of a structure in which an antenna module is disposed in an electronic device.

Referring to FIG. 9, an antenna module may be disposed on an upper portion of the cover of an electronic device 400*g*, and a set substrate 180*g* may be disposed on a lower portion of the cover of the electronic device 400*g*.

Therefore, the antenna module may be disposed in a position higher than a position of a connector 175*g* in the electronic device 400*g*. Since an extension region 152*g* of the second substrate may be bent, a connection path between the connector 175*g* and the antenna module may be easily provided, despite a difference in height between the connector 175*g* and the antenna module.

Figure 10A:
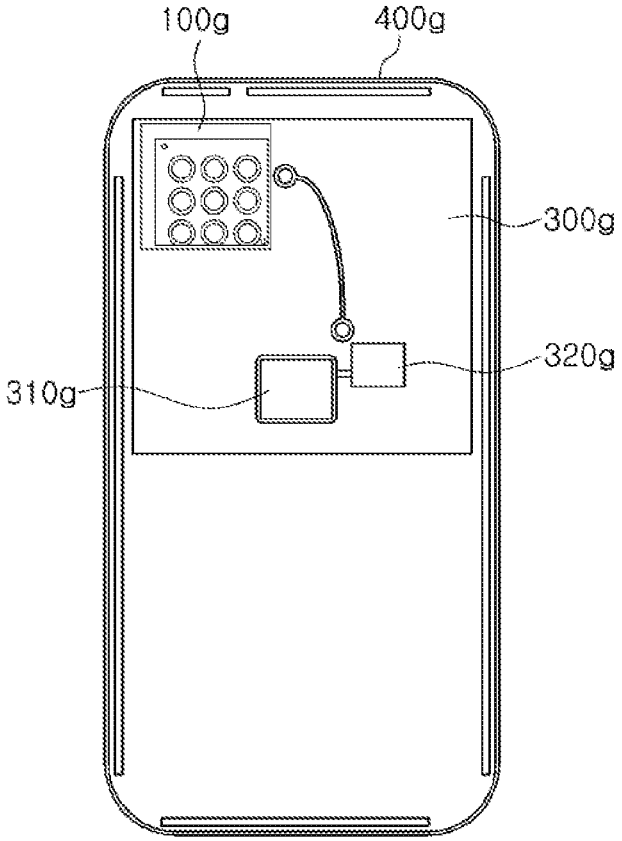
FIGS. 10A and 10B are diagrams illustrating examples of a structure in which an antenna module diagram illustrating an example of is disposed in an electronic device.
Figure 10B:
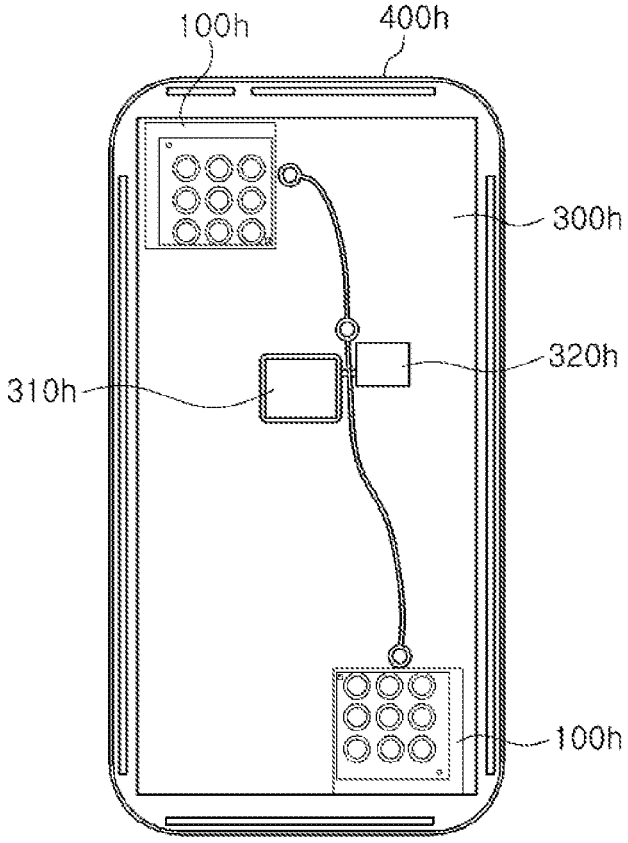

FIGS. 10A and 10B are diagrams illustrating examples of a structure in which an antenna module is disposed in an electronic device.

Referring to FIG. 10A, an electronic device 400*g* may include an antenna module 100*g* and a set substrate 300*g*, and the antenna module 100*g* may be disposed adjacent to a lateral boundary of the electronic device 400*g*.

The electronic device 400*g* may be a smartphone, a wearable smart device, a personal digital assistant, a digital video camera, a digital still camera, a network system, a computer, a monitor, a tablet, a laptop, a netbook, a television, a video game, a smart watch, an automotive, an internet of things (IoT) device, or the like, but is not limited thereto.

A communications modem 310*g* and a second IC 320*g* may be disposed on the set substrate 300*g*. The communications modem 310*g* may include at least a portion of a memory chip, such as, for example, a volatile memory (e.g., a DRAM), a non-volatile memory (e.g., a ROM), and a flash memory; an application processor chip, such as, for example, a central processing unit (e.g., a CPU), a graphics processing unit (e.g., a GPU), a digital signal processor, a cryptographic processor, a microprocessor, and a microcontroller; a logic chip, such as, for example, an analog-to-digital converter and an application-specific IC (ASIC), to perform a digital signal process.

The second IC 320*g* may perform an analog-to-digital conversion, amplification in response to an analog signal, filtering, and frequency conversion to generate a baseband signal or an IF signal, and may process the received baseband signal or IF signal to read communications data. The generated baseband signal or IF signal may be transferred to the antenna module through the second substrate of the antenna module 100*g*.

Referring to FIG. 10B, an electronic device 400*h* may include a plurality of antenna modules 100*h*, a set substrate 300*h*, a communications modem 310*h*, and a second IC 320*h*. The plurality of antenna modules 100*h* may be disposed adjacent to a first lateral boundary and a second lateral boundary of the electronic device 400*h*, respectively.

Meanwhile, the patch antenna, the feed line, the feed via, the shield via, the ground layer, the wiring layer, and the wiring via may include a metallic material, such as, for example, a conductive material, such as copper (Cu), aluminum (Al), silver (Ag), tin (Sn), gold (Au), nickel (Ni), lead (Pb), titanium (Ti), and an alloy thereof, and may be formed according to plating methods such as, for example, a chemical vapor deposition (CVD), a physical vapor deposition (PVD), a sputtering, a subtractive, an additive, a semi-additive process (SAP), and a modified semi-additive process (MSAP).

The dielectric layers and/or insulating layers that may be included in the plurality of substrates may be implemented with a thermosetting resin such as, for example, epoxy resin, as well as FR4, liquid crystal polymer (LCP), low temperature co-fired ceramic (LTCC), or a thermoplastic resin such as polyimide, or a resin impregnated into core materials such as glass fiber, glass cloth and glass fabric together with inorganic filler, prepregs, Ajinomoto build-up film (ABF), FR-4, bismaleimide triazine (BT), photosensitive insulation imageable dielectric (PID) resin, a copper clad laminate (CCL), and a glass or ceramic based insulating material.

The RF signals disclosed in this specification may have a format according to protocols such as, for example Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPS, GPRS, CDMA, TDMA, DECT, Bluetooth, 3G, 4G, 5G, and any other wireless and wired protocols designated as the later ones, but are not limited thereto. In addition, a frequency of the RF signal (for example, 24 GHz, 28 GHz, 36 GHz, 39 GHz, and 60 GHz) may be higher than a frequency of the IF signal (for example, 2 GHz, 5 GHz and 10 GHz).

The plurality of substrates disclosed in this specification may be implemented as a single printed circuit board, may be separately manufactured to have a coupled structure (for example, an electrical connection structure such as a solder ball or a bump is connected), and may include a copper redistribution layer (RDL).

An IC package such as a fan out panel level package (FOPLP) may be applied to a lower surface of a plurality of substrates, and an encapsulant such as a photo-imageable encapsulant (PIE), Ajinomoto build-up film (ABF), epoxy molding compound (EMC)) may be applied adjacent to the boundaries of a plurality of substrates.

Since the antenna module disclosed herein may easily secure an electrical connection path to other modules in an electronic device, a structure for securing the connection path may be simplified, or a limitation of a space for an arrangement to secure the connection path may be reduced. Therefore, the antenna module may have an advantageous structure for improving the antenna performance or miniaturization.

The antenna module disclosed herein may increase the size of the patch antenna, and may improve the antenna performance while suppressing the effective size increase, due to the increase in a space for arranging the patch antenna.

The antenna module disclosed herein may easily secure a side radiation pattern of an RF signal, and thus may have a structure that may be easily miniaturized while extending the transmission/reception direction of the RF signal omnidirectionally.

The antenna module disclosed herein may provide an antenna module capable of improving antenna performance (e.g., transmission/reception ratio, gain, bandwidth, directivity, etc.) or having a structure advantageous for miniaturization.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna module comprising:

two or more substrates stacked and having different flexibility;

a patch antenna disposed above or within an uppermost substrate from among the two or more substrates; and an IC disposed below or within a lowermost substrate from among the two or more substrates, and electrically connected to the patch antenna through the two or more substrates, wherein the two or more substrates comprise a first substrate and a second substrate, wherein the second substrate is more flexible than the first substrate, and extends in a lateral direction to have an overlap region overlapping the first substrate and an extension region not overlapping the first substrate, wherein the antenna module further comprises:

a signal transmission line disposed in the extension region of the second substrate, and electrically connected to the IC; and a second signal transmission line disposed in a second lateral extension region of the second substrate, and electrically connected to the IC, and wherein the second lateral extension region does not overlap the first substrate and comprises an extension of the second substrate in a second lateral direction.

2. The antenna module according to claim 1, further comprising a second patch antenna disposed above or within the extension region of the second substrate, and electrically connected to the IC.

3. The antenna module according to claim 2, further comprising a dummy member disposed on a lower surface of the extension region of the second substrate, wherein an extension region of the second substrate is bent toward a side surface of the two or more substrates.

4. The antenna module according to claim 1, further comprising a first ground layer disposed between the second substrate and the first substrate, and having a first through-hole surrounding the patch antenna in view of a vertical direction.

5. The antenna module according to claim 4, further comprising:

at least one feed via passing through the first through-hole, and electrically connected to the patch antenna; and a second ground layer spaced apart from the overlap region of the second substrate to be disposed on the first substrate, and having a second through-hole through which at least one of the at least one feed via passes, wherein an area of the at least one first through-holes is larger than an area of the at least one second through-holes.

6. The antenna module according to claim 5, further comprising shield vias disposed to electrically connect the first ground layer and the second ground layer, and arranged to surround the patch antenna.

7. The antenna module according to claim 5, wherein the overlap region of the second substrate is disposed between the patch antenna and the first substrate, and a dielectric constant of the first substrate is lower than a dielectric constant of the second substrate.

8. The antenna module according to claim 5, wherein the lowermost substrate comprises a wiring layer disposed between an insulating layer first and a second insulating layer, a wiring of the wiring layer electrically connecting the at least one feed via to the IC.

9. The antenna module according to claim 1, further comprising a second patch antenna disposed on the upper surface of the second lateral extension region of the second substrate, and electrically connected to the IC.

10. The antenna module according to claim 1, further comprising: a third substrate of the two or more substrates being more flexible than the first substrate, and extending in a lateral direction to have a second overlap region overlapping the first substrate and a second extension region not overlapping the first substrate; and a second patch antenna disposed in a position above or within the second extension region of the third substrate, and the second patch antenna is configured to transmit an RF signal to the IC or to receive an RF signal from the IC.

11. The antenna module according to claim 10, wherein the second extension region of the third substrate overlaps at least a portion of the extension region of the second substrate.

12. The antenna module according to claim 1, further comprising: a second patch antenna disposed above or within the extension region of the second substrate, and transmitting an RF signal to the IC or receiving an RF signal from the IC; and a third ground layer disposed between the second patch antenna and the signal transmission line in the extension region of the second substrate.

13. The antenna module according to a claim 1, further comprising:

a first ground layer disposed between the second substrate and the first substrate, and having a through-hole surrounding the patch antenna in view of a vertical direction;

at least one feed via passing through the through-hole, and being electrically connected to the patch antenna; and shield vias disposed on an upper surface of the first ground layer and arranged to surround the patch antenna.

14. An antenna module comprising:

two or more substrates stacked and having different flexibility;

a patch antenna disposed above or within an uppermost substrate from among the two or more substrates; and an IC disposed below or within a lowermost substrate from among the two or more substrates, and electrically connected to the patch antenna through the two or more substrates, wherein the two or more substrates comprise a first substrate and a second substrate, wherein the second substrate is more flexible than the first substrate, and extends in a lateral direction to have an overlap region overlapping the first substrate and an extension region not overlapping the first substrate, and wherein the antenna module further comprises:

a signal transmission line disposed in a position above or within the extension region of the second substrate; and a feed line disposed above or within the overlap region of the second substrate, and electrically connecting the patch antenna and the signal transmission line.

15. The antenna module according to claim 14, further comprising a second patch antenna disposed above or within the extension region of the second substrate, and electrically connected to the IC.

16. The antenna module according to claim 14, further comprising:

a first ground layer disposed between the second substrate and the first substrate, and having a first through-hole surrounding the patch antenna in view of a vertical direction;

at least one feed via passing through the first through-hole, and electrically connected to the patch antenna; and a second ground layer spaced apart from the overlap region of the second substrate to be disposed on the first substrate, and having a second through-hole through which at least one of the at least one feed via passes, wherein an area of the at least one first through-holes is larger than an area of the at least one second through-holes.

17. The antenna module according to claim 16, further comprising shield vias disposed to electrically connect the first ground layer and the second ground layer, and arranged to surround the patch antenna.

18. The antenna module according to claim 16, wherein the lowermost substrate comprises a wiring layer disposed between an insulating layer first and a second insulating layer, a wiring of the wiring layer electrically connecting the at least one feed via to the IC.

19. An antenna module comprising:

two or more substrates stacked and having different flexibility;

a patch antenna disposed above or within an uppermost substrate from among the two or more substrates; and an IC disposed below or within a lowermost substrate from among the two or more substrates, and electrically connected to the patch antenna through the two or more substrates, wherein the two or more substrates comprise a first substrate and a second substrate, wherein the second substrate is more flexible than the first substrate, and extends in a lateral direction to have an overlap region overlapping the first substrate and an extension region not overlapping the first substrate, wherein the antenna module further comprises:

a signal transmission line disposed in the extension region of the second substrate, and electrically connected to the IC; and a second patch antenna disposed on an upper surface of a second lateral extension region of the second substrate, and electrically connected to the IC, and wherein the second lateral extension region does not overlap the first substrate and comprises an extension of the second substrate in a second lateral direction.

20. The antenna module according to claim 19, further comprising:

a first ground layer disposed between the second substrate and the first substrate, and having a through-hole surrounding the patch antenna in view of a vertical direction;

at least one feed via passing through the through-hole, and being electrically connected to the patch antenna; and shield vias disposed on an upper surface of the first ground layer and arranged to surround the patch antenna.

* * * * *